US007892506B2

(12) United States Patent
Seeley

(10) Patent No.: US 7,892,506 B2
(45) Date of Patent: Feb. 22, 2011

(54) COMBUSTIVE DESTRUCTION OF NOXIOUS SUBSTANCES

(75) Inventor: Andrew James Seeley, Bristol (GB)

(73) Assignee: Edwards Limited, Crawley, West Sussex (GB)

( * ) Notice: Subject to any disclaimer, the term of this patent is extended or adjusted under 35 U.S.C. 154(b) by 0 days.

(21) Appl. No.: 12/532,458

(22) PCT Filed: Mar. 18, 2008

(86) PCT No.: PCT/GB2008/050190

§ 371 (c)(1),
(2), (4) Date: Feb. 15, 2010

(87) PCT Pub. No.: WO2008/122819

PCT Pub. Date: Oct. 16, 2008

(65) Prior Publication Data

US 2010/0143221 A1 Jun. 10, 2010

(30) Foreign Application Priority Data

Apr. 4, 2007 (GB) ..... 0706544.4

(51) Int. Cl.
*B01D 53/38* (2006.01)
*B01D 53/68* (2006.01)
*B01D 53/74* (2006.01)

(52) U.S. Cl. ..... 423/210; 423/240 R; 422/168; 422/182; 431/5; 431/7; 431/326; 110/342; 110/345

(58) Field of Classification Search ..... 423/210, 423/240 R; 422/168, 182; 431/5, 7, 326; 110/342, 345
See application file for complete search history.

(56) References Cited

U.S. PATENT DOCUMENTS

| | | | | |
|---|---|---|---|---|
| 3,840,344 | A | 10/1974 | Garbo | |
| 5,749,720 | A | 5/1998 | Fukuda et al. | |
| 5,938,422 | A * | 8/1999 | Smith et al. | 431/5 |
| 6,234,787 | B1 | 5/2001 | Endoh et al. | |
| 2005/0135984 | A1 | 6/2005 | Ferron et al. | |
| 2010/0290966 | A1 * | 11/2010 | Seeley | 423/239.1 |

FOREIGN PATENT DOCUMENTS

| | | | |
|---|---|---|---|
| EP | 0694735 | A1 | 1/1996 |
| EP | 0802370 | A2 | 10/1997 |
| WO | 2006013355 | A1 | 2/2006 |

* cited by examiner

*Primary Examiner*—Timothy C Vanoy

(57) ABSTRACT

Apparatus for the combustive destruction of noxious substances comprises an annular combustion zone (C14) surrounded by the exit surface of an inwardly fired foraminous burner (C32) and surrounding the exit surface of an outwardly fired foraminous burner (C42), means (C12) for injecting a gas stream containing at least one noxious substance into the combustion zone, and means for supplying fuel gas and oxidant to the foraminous burners to effect combustion at the exit surfaces.

29 Claims, 2 Drawing Sheets

COMBUSTIVE DESTRUCTION OF NOXIOUS SUBSTANCES

FIELD OF THE INVENTION

Figure 1:
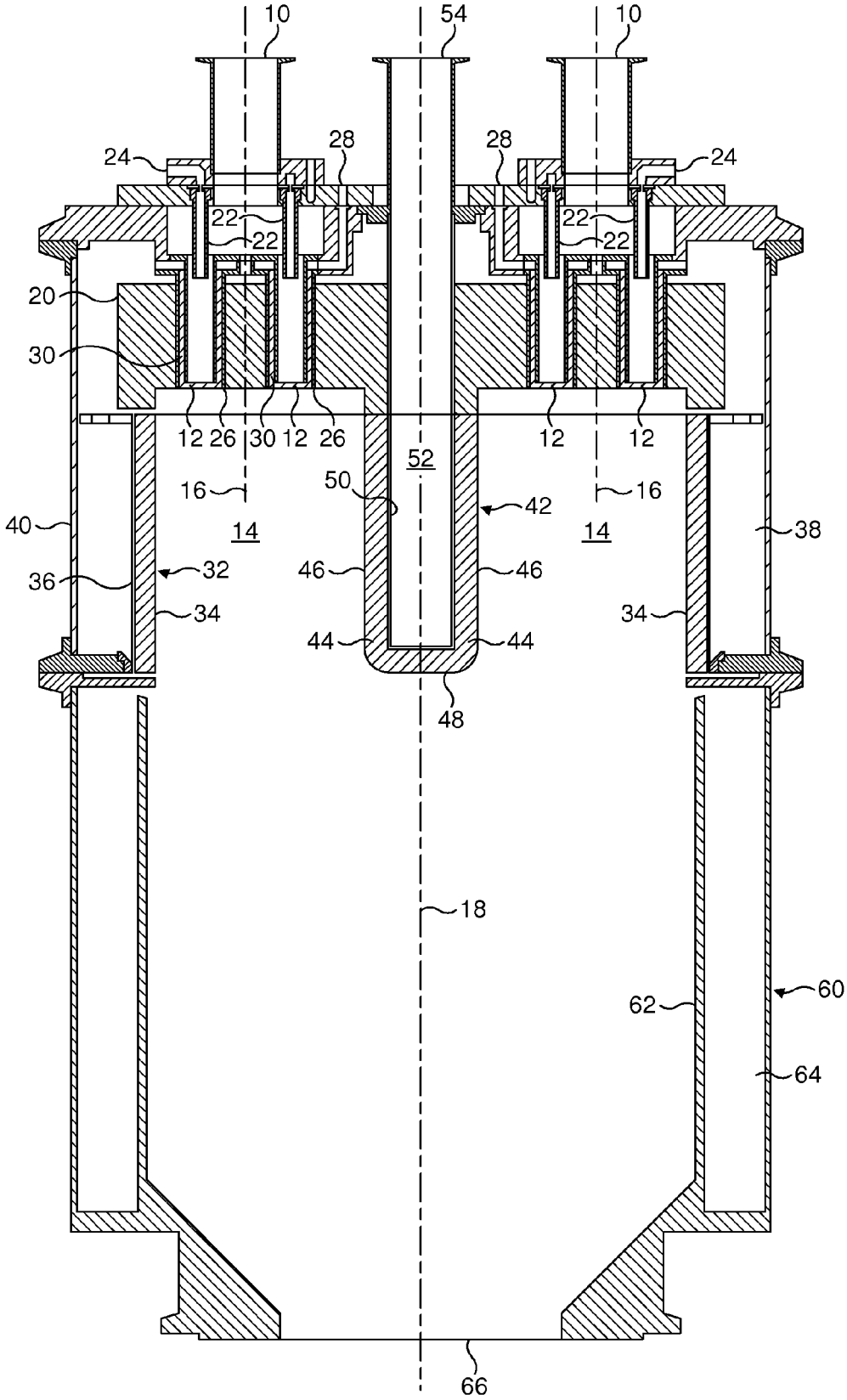

The present invention relates to the combustive destruction of noxious substances, in particular global warming gases, contained within a gas stream, and finds use in the treatment of a gas exhausted from a process tool used in the semiconductor or flat panel display manufacturing industry.

BACKGROUND

Perfluorinated (PFC) gases, such as $CF_4$, $C_2F_6$, $NF_3$ and $SF_6$, are commonly supplied to process chambers used in the semiconductor and flat panel display manufacturing industry for, for example, dielectric layer etching and/or chamber cleaning purposes. Following the manufacturing or cleaning process, there is typically a residual amount of the gas supplied to the process chamber contained in the gas exhausted from the process chamber. The perfluorinated compounds mentioned above are known to be greenhouse gases, and so it is desirable to remove these species from the exhausted gas prior to venting the gas into the atmosphere.

EP-A-0 694 735 describes gas abatement apparatus for treating a gas stream to remove noxious substances from a gas stream, in which a fuel gas is pre-mixed with the gas stream before it is injected through a nozzle into a combustion zone that is laterally surrounded by the exit surface of a cylindrical, inwardly-fired foraminous gas burner. A fuel gas and air are simultaneously supplied to a plenum surrounding the foraminous burner to effect flameless combustion at the exit surface, with the amount of air passing through the foraminous burner being sufficient to consume not only the fuel supplied to the burner but also all of the combustibles in the mixture injected into the combustion zone. The bottom open end of the combustion zone is connected to a cooling column having an inner surface which is coated with a stream of water to cool the gas stream leaving the combustion zone. The gas stream is subsequently separated from the cooling water and passed through a scrubber before being vented to the atmosphere.

Premixing the gas stream with a fuel gas prior to the entry of the stream into the combustion zone was found to improve the PFC abatement efficiency of the apparatus. Whilst good results were obtained with $C_2F_6$, $SF_6$ and $NF_3$, the technique was not applicable to the abatement of $CF_4$ due to the maximum temperature that was attainable within the combustion zone.

A modification of the above technique is described in EP-A-0 802 370, in which the pre-mixed fuel and gas stream is injected into the combustion zone through a nozzle that is concentric with a lance that introduces oxygen into the mixture before it enters the combustion zone. Using this technique, good results were achieved for all PFC gases, including $CF_4$. A further modification is described in WO-A-2006/013355, in which the nozzle is also surrounded by a sleeve for enabling a fuel gas to be injected into the combustion zone with the gas stream, as opposed to pre-mixing the gas stream with fuel. By varying the nature of the gases that are supplied to both the lance and the sleeve, a range of noxious substances can be treated using a single inject stoichiometry. This configuration has been found to be particularly effective at treating a fluorine ($F_2$)-containing gas stream without the generation of $CF_4$ as a combustion by-product.

The cost of ownership of such apparatus is dependent, amongst others, on the amount of fuel gas supplied to the foraminous gas burner. One technique which has been used to reduce fuel consumption has been to reduce the length of the foraminous burner, and thus reduce both the volume of the plenum surrounding the burner, and the quantities of fuel gas and air that need to be supplied to the plenum to effect flameless combustion at the exit surface of the burner.

The exit surface of the foraminous burner emits infrared radiation which assists in maintaining a high temperature within the combustion zone. However, relatively cool conditions prevail towards the bottom of the foraminous burner due to reduced radiation exchange. As the length of the burner is decreased, the proportion of the burner at which these relatively cool conditions prevail is increased. It has been observed that when the aspect ratio (length/internal diameter) of the burner is decreased below a value of 1, the amount of CO and non-combusted fuel gas within the gas stream exhausted from the apparatus starts to increase, and the abatement performance of the apparatus starts to decrease. This poor performance has been attributed to the increased proportion of the burner that operates at a relatively low temperature, effectively placing a limit on the extent to which the aspect ratio of the foraminous burner may be reduced.

Another factor which has affected the cost of ownership of the gas abatement apparatus has been the increase in the size of semiconductor and flat panel process chambers. There is a trend in the manufacture of such devices to conduct processing on increasingly larger substrates to deliver economies of scale, with the substrate being diced upon completion of the processing steps to produce a multiplicity of individual devices of the required size. As a result, the size of the process chambers and the flow rates of the gases supplied thereto, and subsequently exhausted therefrom, have also increased to accommodate the larger substrates and produce acceptable processing rates.

The increase in the amount of gas entering the gas abatement apparatus may be accommodated by increasing both the number of inlets through which the exhaust gas is injected into the combustion zone, and the volume capacity of the combustion zone. For the reasons discussed above, the increase in the volume capacity of the combustion zone cannot be realised by increasing the internal diameter of the foraminous burner alone (in order to accommodate the increased number of inlets required by the increased flow of exhaust gas) without detriment to the performance of the abatement apparatus. Consequently, the length of the combustion zone, and thus also both the length of the foraminous burner and the volume of the plenum surrounding the burner, must also be increased when the internal diameter of the burner is increased, thereby increasing the fuel gas consumption of the apparatus.

SUMMARY

It is an aim of at least the preferred embodiment of the invention to provide gas abatement apparatus including a foraminous gas burner and which is capable of treating a gas stream having a relatively high flow rate with only a relatively low fuel gas consumption.

The present invention provides apparatus for the combustive destruction of noxious substances, comprising a combustion zone surrounded by the exit surface of an inwardly fired foraminous burner, the foraminous burner having an open end through which a combustion product is discharged from the combustion zone, means for injecting a gas stream containing at least one noxious substance into the combustion zone, means for supplying fuel gas and oxidant to the foraminous burner to effect combustion at the exit surface, and characterised by a second burner for heating at least the open end of the foraminous burner.

Providing a second burner for heating at least the open end of the foraminous burner can significantly reduce the temperature differential between the open end of the foraminous burner and the remainder of that burner during use. This can enable the aspect ratio of the foraminous burner to be reduced below a value of 1, for example between 0.4 and 1, without significantly reducing the abatement performance of the apparatus. As a result, the fuel gas consumption of the apparatus can be reduced without detriment to the performance of the apparatus. In addition, the diameter of the apparatus may be increased in order to accommodate an increased number of inlets or other such means through which the gas stream is injected into the combustion zone, and thereby increase the capacity of the apparatus, without detriment to the performance of the apparatus.

The second burner may be at least partially surrounded by the foraminous burner, and may be substantially co-axial with the foraminous burner. In a preferred embodiment, the second burner comprises an outwardly fired foraminous burner surrounded by both the inwardly fired foraminous burner and the combustion zone, the apparatus comprising means for supplying fuel gas and oxidant to the outwardly fired foraminous burner.

The present invention also provides apparatus for the combustive destruction of noxious substances, comprising an annular combustion zone surrounded by an exit surface of an inwardly fired foraminous burner, and surrounding an exit surface of an outwardly fired foraminous burner, means for injecting a gas stream containing at least one noxious substance into the combustion zone, and means for supplying fuel gas and oxidant to the foraminous burners to effect combustion at the exit surfaces.

The means for supplying fuel gas and oxidant to the foraminous burners may be arranged to supply the same mixture of fuel gas and oxidant to both foraminous burners. Alternatively, the means for supplying fuel gas and oxidant to the foraminous burners may be arranged to supply a first mixture of fuel gas and oxidant to the outer, inwardly fired foraminous burner, and a second mixture of fuel gas and oxidant, different from the first mixture, to the inner, outwardly fired foraminous burner. For example, if the required abatement performance can be attained with a lower surface combustion rate (measured in kg-cal per hour per square centimeter of burner surface) at the exit surface of the inner burner, then the proportion of fuel gas contained within the mixture supplied to the inner burner may be lower than that within the mixture supplied to the outer burner, thereby reducing costs.

The foraminous burners may each have a porous layer of ceramic and/or metal fibres. The outer burner may have a different composition than the inner burner, or the two burners may have the same composition.

The means for injecting a gas stream into the combustion zone may be provided by a plurality of groups of nozzles for injecting the gas stream into the combustion zone. These groups of nozzles may be substantially equidistantly spaced about the longitudinal axis about which the annular combustion zone extends.

Each group of nozzles may comprise a plurality of nozzles located about a respective axis extending substantially parallel to and spaced from the longitudinal axis, and these axes may be substantially equidistantly spaced about the longitudinal axis of the annular combustion zone.

Each group of nozzles may comprise at least three nozzles. These nozzles may be arranged about the longitudinal axis so that the nozzles form a first subset of nozzles located at a first radial distance from that axis, and a second subset of nozzles located at a second radial distance from that axis. The apparatus may be provided with at least four groups of nozzles, preferably at least six groups. This can enable the apparatus to be provided with at least eighteen nozzles, which can enable the flow rate of the gas stream into the apparatus to be at least 900 liters per minute.

Each nozzle may have a respective lance projecting thereinto for supplying one of a fuel gas and an oxidant to the portion of the gas stream passing through that nozzle. The nozzle may extend about the lance, and is preferably substantially concentric with the lance.

Each nozzle may also have a respective sleeve extending thereabout for supplying one of a fuel gas and an oxidant to the to the portion of the gas stream passing through that nozzle. This sleeve may be substantially concentric with the nozzle, and the nozzle may terminate within the sleeve.

The provision of both a lance and a sleeve for each nozzle can enable the combustion conditions within the combustion zone to be optimised for a particular noxious substance or substances contained within the gas stream. For example, the lance can selectively inject an oxidant into the gas stream, and the sleeve can selectively inject a fuel into the gas stream. Thus, a fuel, an oxidant or both a fuel and an oxidant can be injected into the gas stream as required by simply switching on and off the fluid flows to the lance and the sleeve.

A cooling column may be provided below and in fluid communication with the combustion zone, along with means for maintaining a flow of water along the inner surface of the cooling column, and a gas-liquid separator connected to the bottom of the column. This can enable the combustion product stream leaving the combustion zone to be cooled whilst enabling some of the acidic gases contained within the gas stream, such as HF and HCl, to be taken into solution by the water flow coating the inner surface of the column, and enabling solid particulates to be captured by this water flow.

The present invention also provides a method for the combustive destruction of noxious substances, comprising injecting a gas stream containing at least one noxious substance into a combustion zone surrounded by the exit surface of an inwardly fired foraminous burner having an open end, supplying fuel gas and oxidant to the foraminous burner to effect combustion at the exit surface, and discharging a combustion product from the combustion zone through the open end of the foraminous burner, characterised in that the open end of the foraminous burner is heated by a second burner.

The present invention further provides a method for the combustive destruction of noxious substances, comprising injecting a gas stream containing at least one noxious substance into an annular combustion zone surrounded by the exit surface of an inwardly fired foraminous burner and surrounding the exit surface of an outwardly fired foraminous burner, and supplying fuel gas and oxidant to the foraminous burners to effect combustion at the exit surfaces.

Features described above in relation to the apparatus aspect of the invention are equally applicable to the method aspect, and vice versa.

BRIEF DESCRIPTION OF THE DRAWGINS

Figure 2:
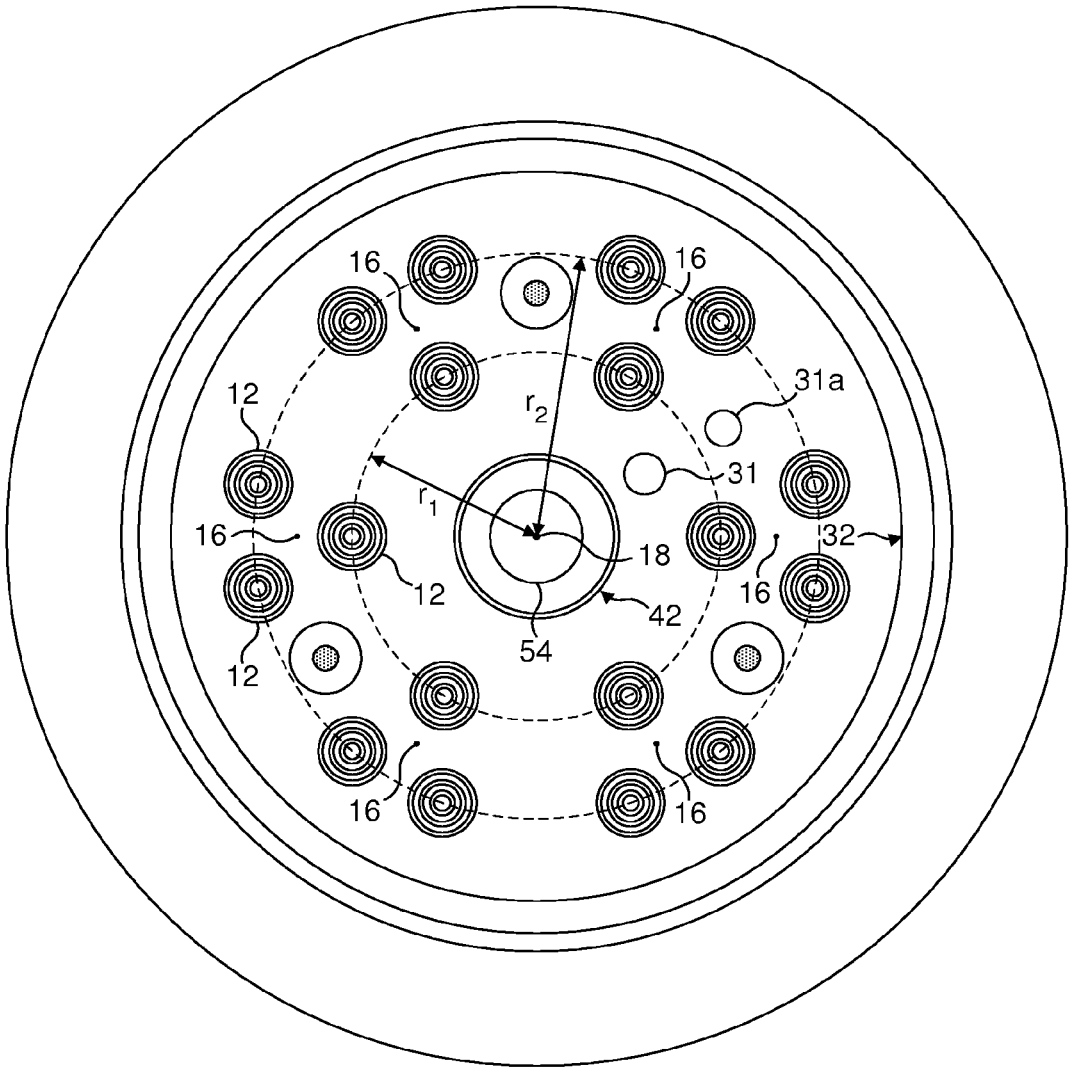

Preferred features of the present invention will now be described, by way of example only, with reference to the accompanying drawings, in which FIG. 1 illustrates a cross-section through an apparatus for the combustive destruction of noxious substances; and FIG. 2 illustrates the arrangement of nozzles for injecting a gas stream into the combustion zone of the apparatus of FIG. 1.

DETAILED DESCRIPTION

With reference first to FIG. 1, the apparatus comprises a plurality of inlets 10, in this example six inlets, for receiving a gas stream pumped from a semiconductor or flat panel display process tool by means of a vacuum pumping system. The gas stream is conveyed from each inlet 10 to a respective group of nozzles 12, which inject the gas stream into a combustion zone 14. In this example, each group of nozzles 12 comprises three nozzles which are arranged about a respective axis 16 extending substantially parallel to the longitudinal axis 18 of the combustion zone 14. These axes 16 are preferably substantially equally radially spaced from the longitudinal axis 18, and are preferably substantially equally angularly spaced about that axis 18. Within each group, the nozzles 12 may be arranged as desired about their common axis 16, but in a preferred arrangement illustrated in FIG. 2 one of the nozzles is located at a first radial distance $r_1$ from the longitudinal axis 18, and the other two nozzles are located at a second, greater radial distance $r_2$ from the longitudinal axis 18.

Each nozzle 12 is located within a respective bore formed in a ceramic plate 20, which defines the upper (as shown) surface of the combustion chamber 14. To enable the combustion conditions within the combustion chamber 14 to be optimised for a particular noxious substance contained in the gas stream, each nozzle 12 extends about, and is substantially concentric with, a lance 22 which receives a supply of an oxidant, for example air, from an oxidant inlet 24. As illustrated in FIG. 1, each of the lances 22 associated with the nozzles 12 of a single gas inlet 10 may be supplied with oxidant via a common oxidant inlet 24. The six oxidant inlets 24 may be conveniently connected to a shared oxidant source.

Each nozzle 12 is optionally surrounded by a second, concentric nozzle, or sleeve, 26, each of which is located within a respective bore formed in the plate 20. Each sleeve 26 surrounds a respective nozzle 12 such that the outlet from the nozzle 12 is located within the sleeve 26. A fuel gas inlet 28 supplies a fuel gas to an annular gas passage 30 defined between the outer surface of the nozzle 12 and the inner surface of the sleeve 26 to enable the fuel gas, for example methane, to be conveyed into the combustion zone 14 with the gas stream and any oxidant that has been injected into the gas stream by the lance 22. As illustrated in FIG. 1, each of the sleeves 26 associated with the nozzles 12 of a single gas inlet 10 to may be supplied with fuel gas via a common fuel gas inlet 28. The six fuel gas inlets 28 may be conveniently connected to a shared fuel gas source.

A controller (not shown) may be provided to control the relative amounts of fuel gas and oxidant that are supplied to the fuel gas inlets 28 and the oxidant inlets 24 to optimise the combustion of the noxious substance(s) contained in the gas stream. For example, for the combustive abatement of organo-silane, oxygen is injected into the gas stream through the lances 22. As another example, for the combustive abatement of $F_2/NF_3$ species contained in the gas stream, fuel gas is injected into the gas stream through the gas passages 30 to provide the necessary reducing species. Optionally, oxygen may also be injected into the gas stream through the lances 22 to produce combustion conditions that result in low residual hydrocarbons and low carbon monoxide emissions from the apparatus.

Returning to FIG. 1, in this example the combustion zone 14 is annular, and is surrounded by the exit surface of an outer, inwardly fired foraminous burner 32, such as that described in EP-A-0 694 735. The outer burner 32 has a porous layer 34 of ceramic and/or metal fibres deposited on, or attached to, an annular screen 36. A plenum volume 38 is formed between the burner screen 36 and an cylindrical outer shell 40. A mixture of fuel gas, such as natural gas, or a hydrocarbon, and air is introduced into the plenum volume 38 via one or more inlet nozzles (not shown) so that, during use, the mixture of fuel gas and air will burn without visible flame at the exit surface of the outer burner 32. The lower end (as shown) of the combustion zone 14 is open to allow the combustion products to be output from the zone 14.

During use, the exit surface of the outer burner 32 emits infrared radiation which assists in maintaining a high temperature within the combustion zone 14. In order to avoid problems associated with reduced radiation exchange at the open end of the outer burner 32, a second burner is provided for heating at least the open end of the outer burner 32. In this example, this second burner is provided by an inner, outwardly fired foraminous burner 42 surrounded by, and substantially concentric with, the annular combustion zone 14. Similar to the outer burner 32, the inner burner 42 has a porous layer 44 of ceramic and/or metal fibres, which may have either the same composition as the porous layer 34 of the outer burner 32 or a different composition than that porous layer. As illustrated in FIG. 1, the porous layer 44 has an annular sidewall 46 surrounded by the combustion zone 14, and an end wall 48 which closes the end of the inner burner 42. The porous layer 44 is deposited on a tubular screen 50 which defines a cylindrical plenum volume 52 of the inner burner 42. A mixture of fuel gas, such as natural gas, or a hydrocarbon, and air is introduced into this plenum volume 52 via inlet 54 so that, during use, this mixture of fuel gas and air will burn without visible flame at the exit surface of the inner burner 44. The mixture of fuel gas and air which is supplied to the cylindrical plenum volume 52 may be the same as, or different from, the mixture of fuel gas and air which is supplied to the annular plenum volume 38 of the outer burner 32.

In use, a gas stream containing one or more noxious substances, for example a halogenated species, is supplied to the inlets 10. Fuel gas and oxidant is added to the gas stream as required by the lances 22 and the sleeves 26 before the gas is injected into the annular combustion zone 14. Excess air exiting from the porous fibres layers of the burners 32, 42 achieves the combustive destruction of the noxious substances within the combustion zone 14.

An igniting pilot burner is provided for igniting the outer and inner burners 32, 42. The pilot burner may be of a conventional type having a sparking plug for igniting a mixture of fuel gas and oxidant supplied to an additional nozzle 31, similar in size to the nozzles 12 and also located in a bore extending through the ceramic plate 20. As illustrated in FIG. 2, the pilot burner may be located proximate to the inner burner 42 for igniting the inner burner 42, which in turn ignites the outer burner 32. Alternatively, a second pilot burner may be provided proximate to the outer burner 32 for igniting this burner. The pilot burner(s) is provided solely for the purpose of igniting the outer and inner burners 32, 42, and so may be extinguished once these burners 32, 42 have been ignited. As also illustrated in FIG. 2, a viewing port 31*a* may be provided adjacent to this nozzle 31.

The length of the inner burner 42 (as measured in the direction of the longitudinal axis 18) is substantially the same as that of the outer burner 32. In one example, each burner 32,42 has a length of approximately 6 inches, with the inner burner 42 having an outer diameter of approximately 2.5 inches and the outer burner having an inner diameter of approximately 12 inches. This can enable the apparatus to be provided with up to 18 nozzles for injecting the gas stream into the annular combustion zone 14, which can enable the apparatus to receive at least 900 liters per minute of gas. In comparison, in the example stated in EP-A-0 694 735, the (single) inwardly fired foraminous burner has a diameter of 3 inches, and a length of 12 inches, and consequently a much lower volume capacity. In view of the heating of the open end of the outer foraminous burner 32 by the inner burner 42, good abatement performance with low CO and fuel gas emissions can be achieved with a fuel consumption in the range from 40 to 50 liters per minute.

The open end of the combustion zone 14 is connected to a cylindrical post-combustion chamber 60 comprising a water-cooling column 62 for receiving the combustion product stream flowing from the combustion zone 14. Water is supplied to an annular trough 64 surrounding the cooling column 62 through a pipe (not shown) so that the water overflows from the top of the trough 64 and streams down the inner surface of the cooling column 62. The water serves to cool the combustion product stream and prevent solid particulates from being deposited on the surface of the cooling column 62. In addition, any acidic components of the combustion product stream may be taken into solution by the water. The length of the chamber 60 may be selected to optimise the abatement performance of the apparatus. The gas stream and water are discharged through the outlet 66 of the chamber 60 may be conveyed to a separator (not shown) for separating the water, now containing solid particulates and acidic species, from the gas stream. The gas stream may then be conveyed through a wet scrubber to remove remaining acidic species from the gas stream before it is vented to the atmosphere.

I claim:

1. Apparatus for the combustive destruction of noxious substances, comprising a combustion zone surrounded by the exit surface of an inwardly fired foraminous burner, the foraminous burner having an open end through which a combustion product is discharged from the combustion zone, means for injecting a gas stream containing at least one noxious substance into the combustion zone, means for supplying fuel gas and oxidant to the foraminous burner to effect combustion at the exit surface, and characterised by a second burner for heating at least the open end of the foraminous burner.

2. Apparatus according to claim 1, wherein the second burner is at least partially surrounded by the foraminous burner.

3. Apparatus according to claim 1, wherein the second burner is substantially co-axial with the foraminous burner.

4. Apparatus according to claim 1, wherein the second burner comprises an outwardly fired foraminous burner surrounded by both the inwardly fired foraminous burner and the combustion zone, the apparatus comprising means for supplying fuel gas and oxidant to the outwardly fired foraminous burner.

5. Apparatus for the combustive destruction of noxious substances, comprising an annular combustion zone surrounded by an exit surface of an inwardly fired foraminous burner, and surrounding an exit surface of an outwardly fired foraminous burner, means for injecting a gas stream containing at least one noxious substance into the combustion zone, and means for supplying fuel gas and oxidant to the foraminous burners to effect combustion at the exit surfaces.

6. Apparatus according to claim 5, wherein the means for supplying fuel gas and oxidant to the foraminous burners is arranged to supply the same mixture of fuel gas and oxidant to both foraminous burners.

7. Apparatus according to claim 5, wherein the means for supplying fuel gas and oxidant to the foraminous burners is arranged to supply a first mixture of fuel gas and oxidant to the inwardly fired foraminous burner, and a second mixture of fuel gas and oxidant, different from the first mixture, to the outwardly fired foraminous burner.

8. Apparatus according to claim 5, wherein the foraminous burners each have a porous layer of ceramic and/or metal fibres.

9. Apparatus according to claim 8, wherein the inwardly fired foraminous burner has a different composition than the outwardly fired foraminous burner.

10. Apparatus according to claim 5, wherein the means for injecting a gas stream into the combustion zone comprises a plurality of groups of nozzles for injecting the gas stream into the combustion zone.

11. Apparatus according to claim 10, wherein the annular combustion zone extends about a longitudinal axis, and wherein the groups of nozzles are substantially equidistantly spaced about the longitudinal axis.

12. Apparatus according to claim 11, wherein each group of nozzles comprises a plurality of nozzles located about a respective axis extending substantially parallel to and spaced from the longitudinal axis.

13. Apparatus according to claim 10, wherein each group of nozzles comprises at least three nozzles.

14. Apparatus according to claim 10, comprising at least four groups of nozzles.

15. Apparatus according to claim 10, wherein each nozzle has a respective lance projecting thereinto for supplying one of a fuel gas and an oxidant to the portion of the gas stream passing through that nozzle.

16. Apparatus according to claim 15, wherein the nozzle extends about the lance.

17. Apparatus according to claim 15, wherein the nozzle is substantially concentric with the lance.

18. Apparatus according to claim 10, wherein each nozzle has a respective sleeve extending thereabout for supplying one of a fuel gas and an oxidant to the to the portion of the gas stream passing through that nozzle.

19. Apparatus according to claim 18, wherein the sleeve is substantially concentric with the nozzle.

20. Apparatus according to claim 18, wherein the nozzle terminates within the sleeve.

21. Apparatus according to claim 5, wherein the aspect ratio of the inwardly fired foraminous burner has a value of less than 1.

22. Apparatus according to claim 5, comprising a cooling column below and in fluid communication with the combustion zone, means for maintaining a flow of water along the inner surface of the cooling column, and a gas-liquid separator connected to the bottom of the column.

23. A method for the combustive destruction of noxious substances, comprising injecting a gas stream containing at least one noxious substance into a combustion zone surrounded by the exit surface of an inwardly fired foraminous burner having an open end, supplying fuel gas and oxidant to the foraminous burner to effect combustion at the exit surface, and discharging a combustion product from the combustion zone through the open end of the foraminous burner, characterised in that the open end of the foraminous burner is heated by a second burner.

24. A method according to claim 23, wherein the open end of the foraminous burner is heated by an outwardly fired foraminous burner surrounded by the inwardly fired foraminous burner and to which a fuel gas and an oxidant is supplied to effect combustion at an exit surface thereof.

25. A method for the combustive destruction of noxious substances, comprising injecting a gas stream containing at least one noxious substance into an annular combustion zone surrounded by the exit surface of an inwardly fired foraminous burner and surrounding the exit surface of an outwardly fired foraminous burner, and supplying fuel gas and oxidant to the foraminous burners to effect combustion at the exit surfaces.

26. A method according to claim 25, wherein the same mixture of fuel gas and oxidant is supplied to both of the foraminous burners.

27. A method according to claim 25, wherein different mixtures of fuel gas and oxidant are supplied to the foraminous burners.

28. A method according to claim 25, wherein one of a fuel gas and an oxidant is supplied to the gas stream prior to injection into the combustion zone.

29. A method according to claim 25, wherein the gas stream is discharged through an open bottom of the combustion zone into a column having an inner surface along which a flow of water is maintained.

* * * * *